US009326605B2

(12) United States Patent
Schollmeyer et al.

(10) Patent No.: US 9,326,605 B2
(45) Date of Patent: May 3, 2016

(54) BUMPER FOR A MERCHANDISER

(71) Applicant: Hussmann Corporation, Bridgeton, MO (US)

(72) Inventors: Cody J. Schollmeyer, Wentzville, MO (US); Mel Aumiller, Chesterfield, MO (US); Thomas C. Wind, Wildwood, MO (US)

(73) Assignee: Hussmann Corporation, Bridgeton, MO (US)

( * ) Notice: Subject to any disclaimer, the term of this patent is extended or adjusted under 35 U.S.C. 154(b) by 7 days.

(21) Appl. No.: 14/445,947

(22) Filed: Jul. 29, 2014

(65) Prior Publication Data

US 2016/0029796 A1 Feb. 4, 2016

(51) Int. Cl.
*A47B 96/00* (2006.01)
*A47B 96/20* (2006.01)

(52) U.S. Cl.
CPC ..... *A47B 96/201* (2013.01); *A47B 2220/0061* (2013.01)

(58) Field of Classification Search
CPC ..... A47B 96/201; A47B 97/043
USPC ..... 312/137, 140.4; 248/345.1; 52/716.1, 52/716.3, 716.4, 716.7
See application file for complete search history.

(56) References Cited

U.S. PATENT DOCUMENTS 625,396 A * 5/1899 Huss ..... A47F 5/005 312/140.4
1,891,157 A * 12/1932 Heuer ..... A47B 69/00 312/140.2
2,683,328 A 7/1954 Thulin
2,988,018 A 6/1961 Stough
3,116,701 A 1/1964 Stough
3,861,110 A * 1/1975 Bartlett ..... E04F 19/026 293/1
3,991,537 A * 11/1976 Brown ..... E04F 19/026 248/188.8
4,142,766 A 3/1979 Swerbinsky
4,196,552 A 4/1980 Bartlett
5,584,189 A * 12/1996 Bustos ..... A47F 3/0408 62/255
5,836,134 A 11/1998 Couto et al.
7,770,861 B2 8/2010 Huxtable et al.
8,828,522 B1 * 9/2014 Bennett ..... A47B 95/043 428/188
2003/0230095 A1 * 12/2003 Kahler ..... A47F 3/0486 62/155
2005/0005565 A1 1/2005 McSharry et al.
2005/0016116 A1 1/2005 Scherff
2005/0193755 A1 * 9/2005 Duffy ..... A47F 3/0482 62/246
2005/0217297 A1 * 10/2005 Wilson ..... A47F 3/0443 62/255
2007/0193293 A1 * 8/2007 Hostetler ..... A47F 3/0426 62/246

FOREIGN PATENT DOCUMENTS

EP 0297358 A1 1/1989
JP 2003072849 A 3/2003

* cited by examiner

*Primary Examiner* — James O Hansen
(74) *Attorney, Agent, or Firm* — Michael Best & Friedrich LLP

(57) ABSTRACT

A merchandiser including a case that has a base and side walls extending upward from the base to at least partially define a product display area. The merchandiser also includes a bracket that is coupled to the base, and a bumper assembly that is coupled to an exterior surface of the base. The bumper assembly includes a shock absorber that has at least one end removably coupled to the base by a quick release mechanism engaged with the bracket and the shock absorber, and a bumper coupled only to an outermost portion of the shock absorber.

20 Claims, 8 Drawing Sheets

BUMPER FOR A MERCHANDISER

BACKGROUND

The present invention relates to a merchandiser and, more specifically, to a merchandiser including a bumper that protects a base of the merchandiser from damage.

Merchandisers can be subjected to collisions from stray objects such as shopping carts, fork-lifts, ladders, and other various objects. These collisions often damage the merchandiser such that the aesthetic appeal of the merchandiser is diminished. While some merchandisers include bumpers that resist damage, these bumpers are often difficult to assemble or remove from the merchandiser and typically require tools to do so.

SUMMARY

In one aspect, the invention provides a merchandiser including a case that has a base and side walls extending upward from the base to at least partially define a product display area. The merchandiser also includes a bracket that is coupled to the base, and a bumper assembly that is coupled to an exterior surface of the base. The bumper assembly includes a shock absorber that has at least one end removably coupled to the base by a quick release mechanism engaged with the bracket and the shock absorber, and a bumper coupled only to an outermost portion of the shock absorber.

In another aspect, the invention provides the merchandiser with a bumper assembly including shock absorbers that are attached to and extending outward from the exterior surface. The shock absorbers are spaced apart from each other along the base. The bumper assembly also includes an elongate bumper coupled to distal ends of the shock absorbers and biased outward from the base by the shock absorbers.

In another aspect, the invention provides the merchandiser with a bumper assembly including a shock absorber that has a first end coupled to the base and a second end coupled to the base such that the shock absorber extends horizontally along the base when the shock absorber is coupled to the base. The shock absorber has a central portion that is disposed between the first end and the second end and that is spaced from the exterior surface, and an elongate bumper is coupled to the shock absorber.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
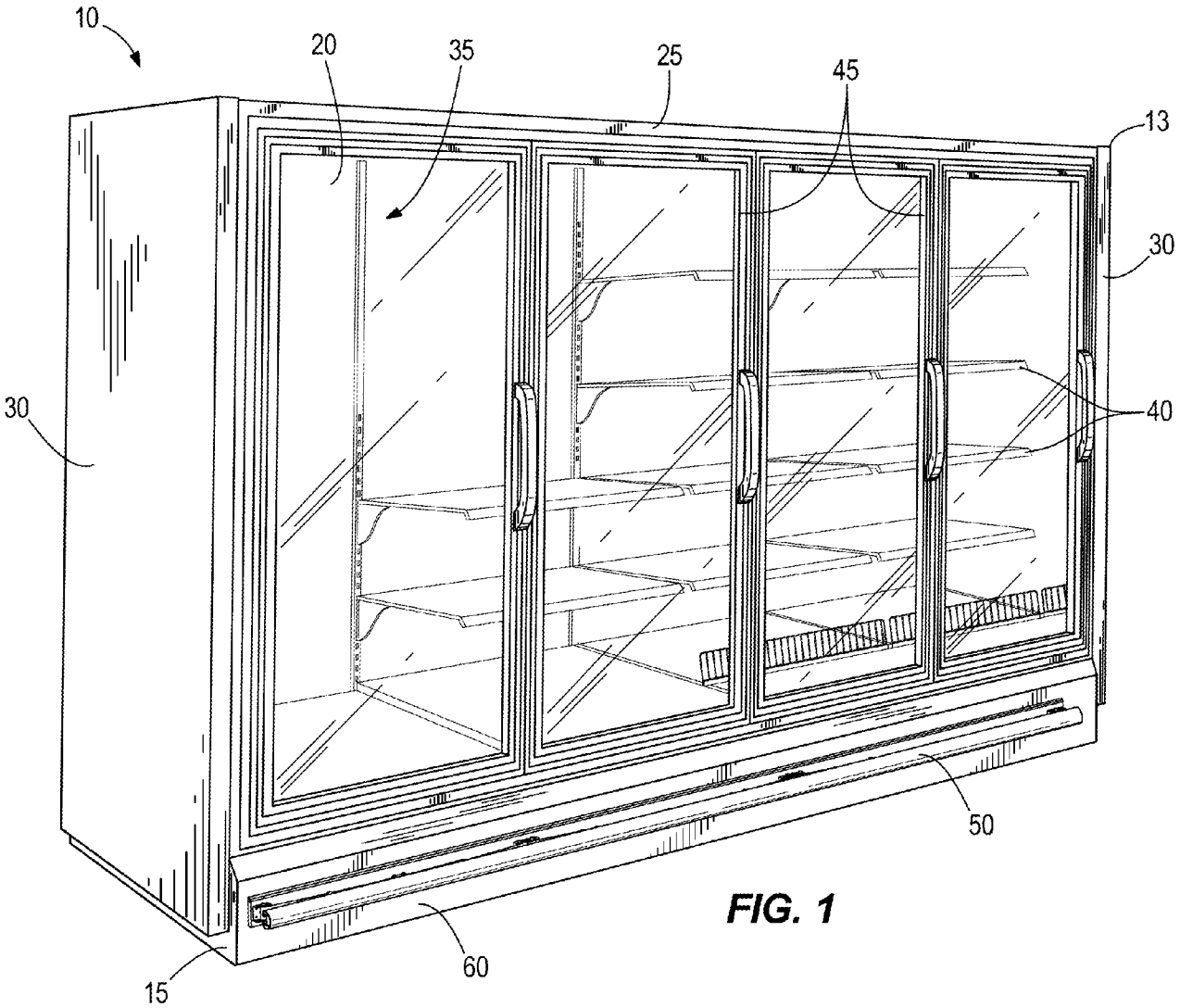
FIG. 1 is a perspective view of a merchandiser including an exemplary bumper assembly embodying the invention.
Figure 6:
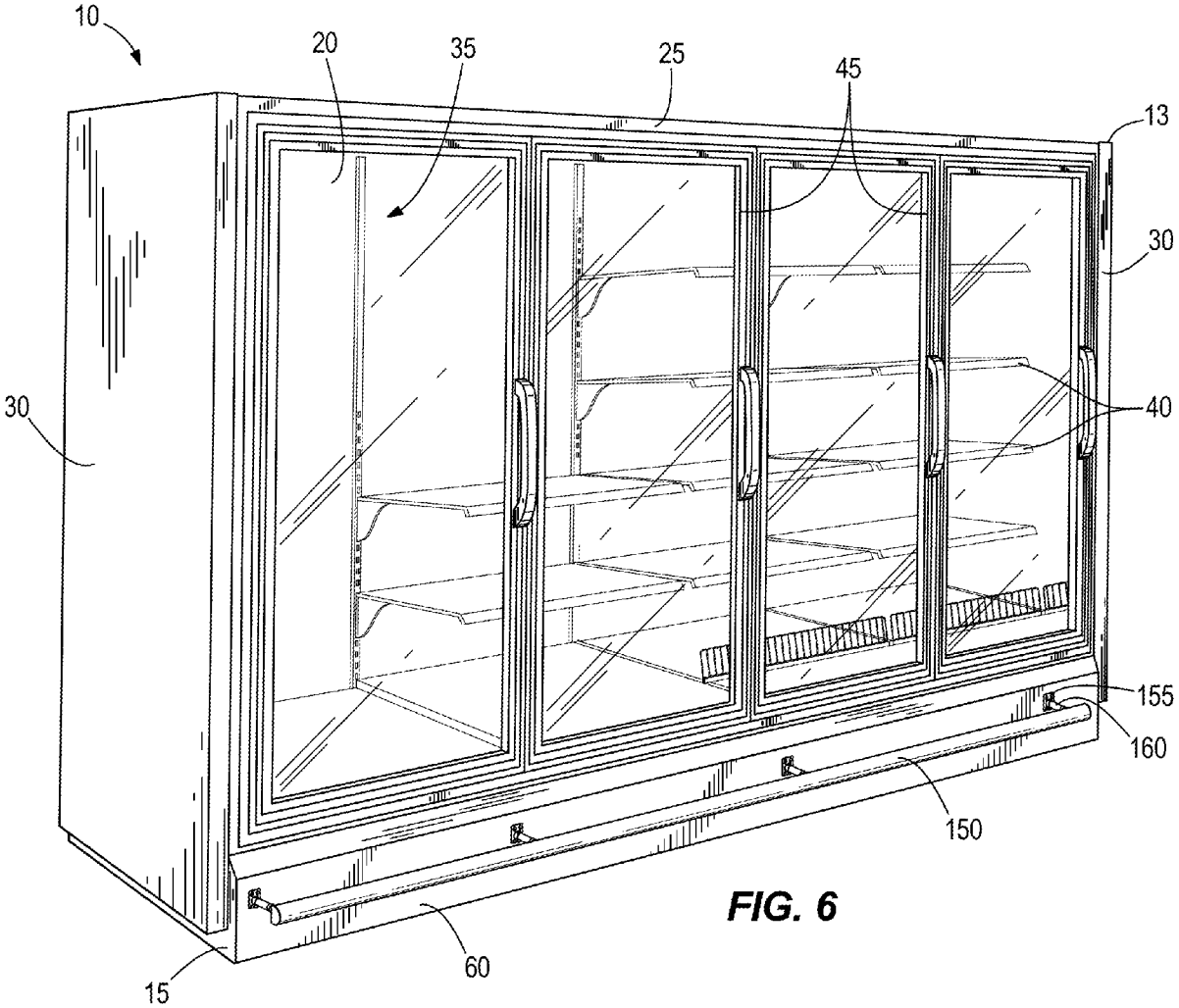
FIG. 6 is a perspective view of the merchandiser including another exemplary bumper assembly embodying the invention.

FIGS. 1 and 6 illustrate exemplary merchandisers 10 that may be located in a supermarket or a convenience store or other retail settings (not shown) for presenting fresh food, beverages, and other product (not shown) to consumers. As shown, each merchandiser 10 is an upright refrigerated merchandiser including a case 13 that has a base 15, a rear wall 20, a top wall or canopy 25, and opposite side walls 30 of the merchandiser 10. The area partially enclosed by the base 15, the rear wall 20, the canopy 25, and the side walls 30 at least partially defines a product display area 35 in which food product can be supported (e.g., on shelves 40). Optional doors 45 enclose the product display area 35. It should be appreciated that the merchandiser 10 can take other forms (e.g., horizontal style merchandisers, open-front merchandisers, etc.), and that the merchandiser 10 can be an ambient-temperature merchandiser, a heated merchandiser, or a refrigerated merchandiser.

Figure 2:
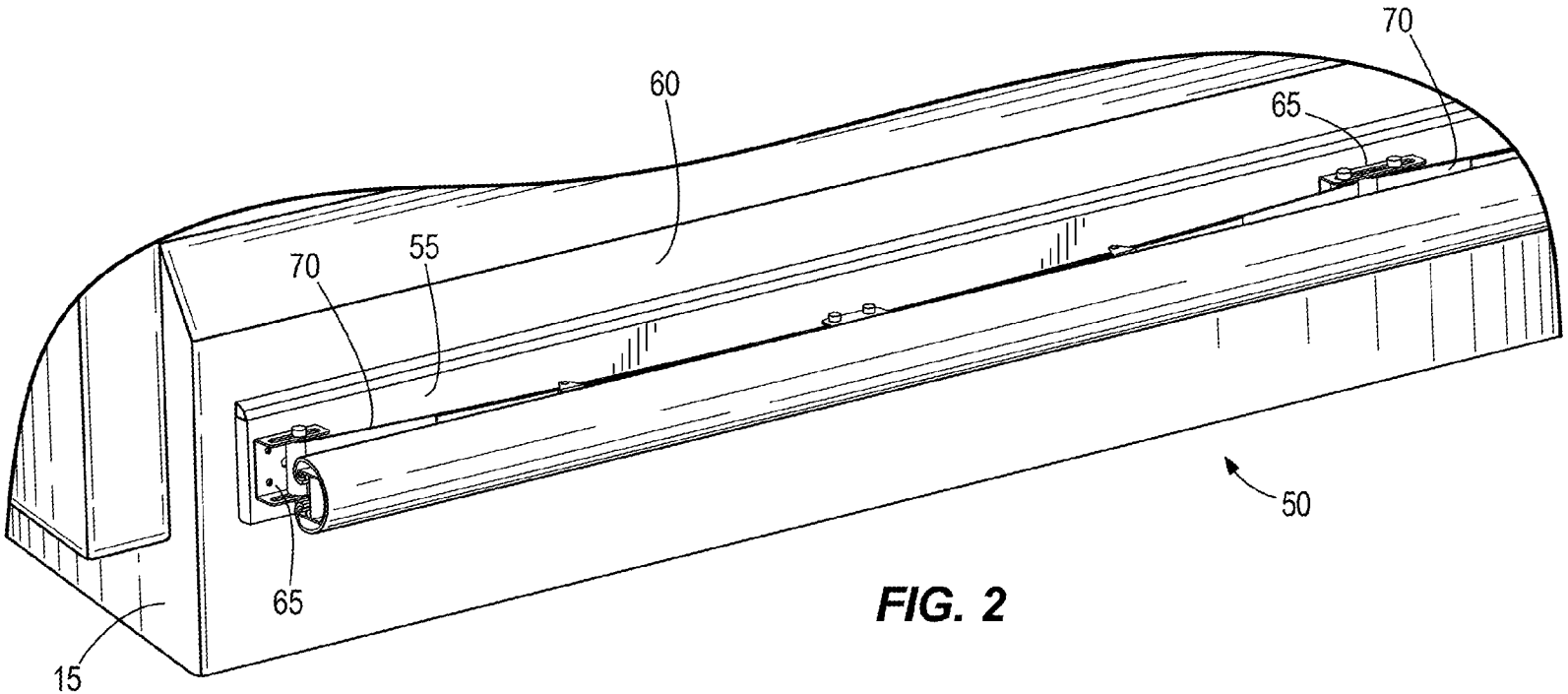
FIG. 2 is a perspective view of a portion of the merchandiser of FIG. 1 including the bumper assembly.

Referring to FIGS. 1 and 2, the merchandiser 10 includes an exemplary bumper assembly 50 that is removably attached to the base 15 by a bumper platform 55. The bumper platform 55 is attached to (e.g., bolted, adhered, etc.) and extending along an exterior surface 60 of the merchandiser base 15, and brackets 65 are coupled between the bumper assembly 50 and the bumper platform 55. The bumper platform 55 and the brackets 65 can be part of the bumper assembly 50 or provided separate from the bumper assembly 50.

Figure 3:
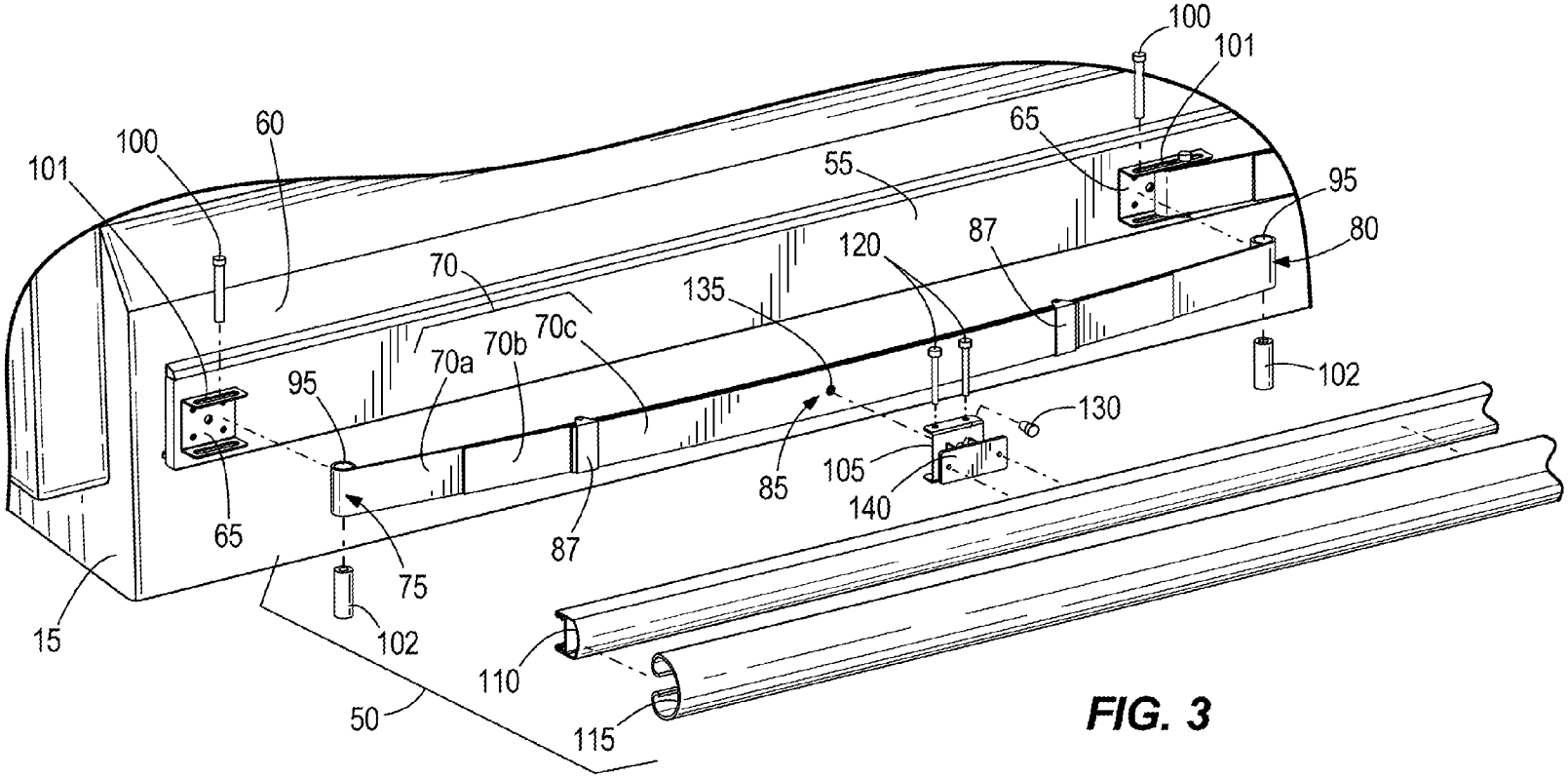
FIG. 3 is an exploded view of a portion of the bumper assembly of FIG. 1.
Figure 4:
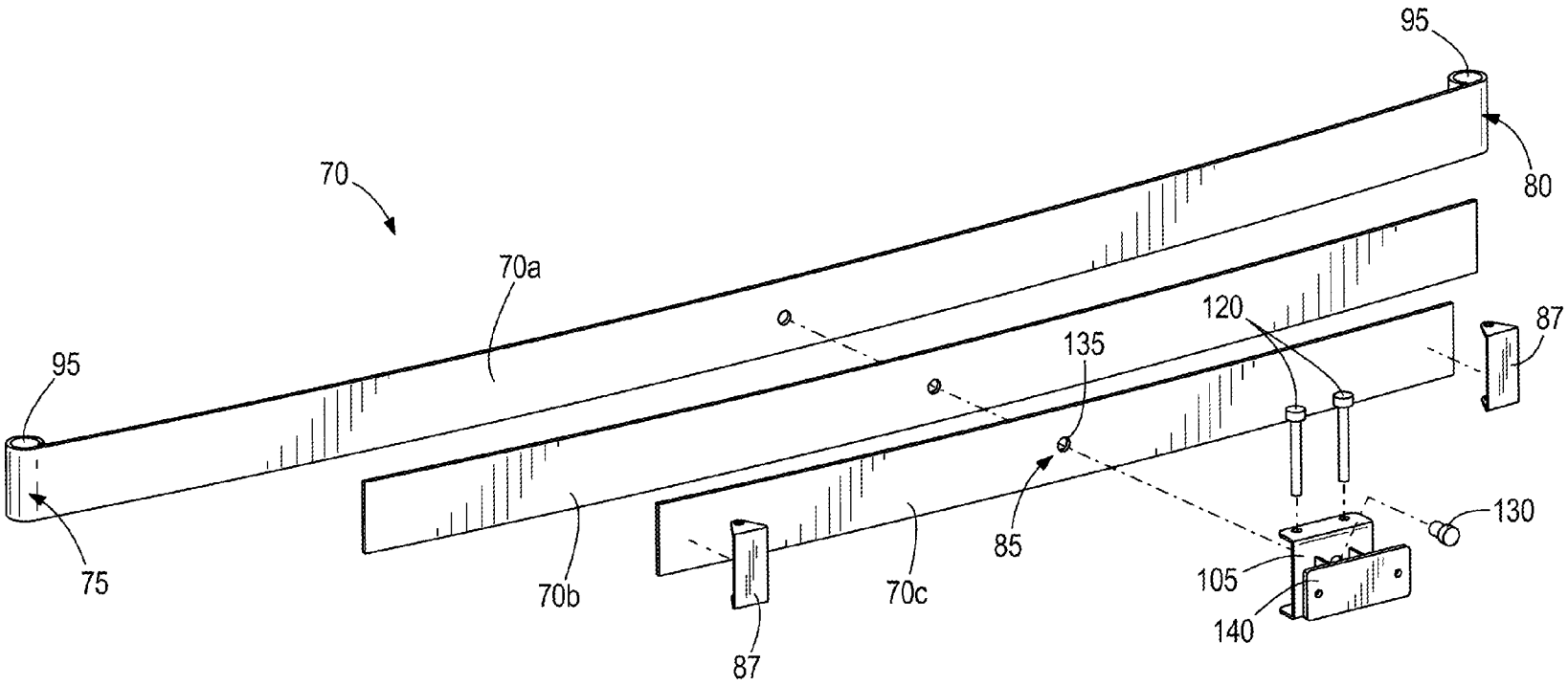
FIG. 4 is an exploded view of shock absorbers of the bumper assembly illustrated in FIGS. 1 and 3.
Figure 5:
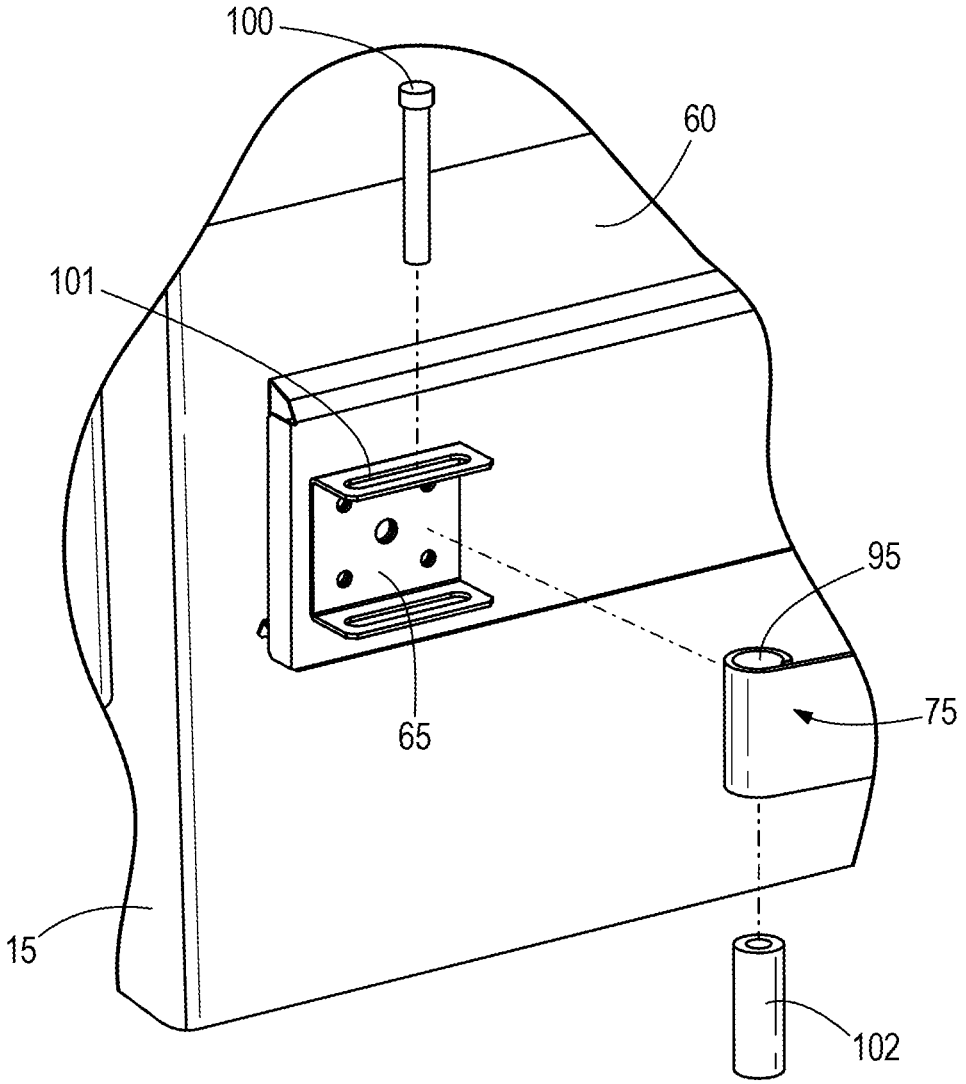
FIG. 5 is an enlarged perspective view of the attachment between the shock absorber and the merchandiser.

With reference to FIGS. 3-5, the bumper assembly 50 includes a plurality of horizontally-extending resilient members or shock absorbers 70 (referred to as "shock absorbers" for purposes of description only). Each shock absorber 70 has a first end 75 that is coupled to the base 15 (e.g., via one bracket 65), and a second end 80 that is coupled to the base 15 (e.g., via another bracket 65). The shock absorber 70 extends horizontally along the base 15 and has a central portion 85 that is disposed between the first end 75 and the second end 80 and that is spaced from the exterior surface 60. That is, the shock absorber 70 is only connected to the base 15 at or adjacent the first and second ends 75, 80. The central portion 85 defines the outermost portion of the shock absorber 70 relative to the base 15 (i.e. when viewing the bumper assembly 50 in a horizontal plane).

Each shock absorber 70 is defined by leaf springs 70*a-c* arranged in a stacked relationship (FIG. 4), although other elements that facilitate shock absorption can be used and are considered herein. For example, and with continued reference to FIG. 4, the shock absorber 70 has a primary leaf spring 70*a*, a secondary leaf spring 70*b*, and a tertiary leaf spring 70*c* that are coupled to each other (e.g., in a layered fashion) by rebound clips 87. The primary leaf spring 70*a* has a first length corresponding to the distance between connection points for the first and second ends 75, 80 on the support brackets 65. The secondary leaf spring 70*b* is coupled to an outer side of the primary leaf spring 70*a* and has a second length that is shorter than the first length of the primary leaf spring 70*a*. The tertiary leaf spring 70*c* is coupled to an outer side of the secondary leaf spring 70*b* and has a third length that is shorter than the first length and the second length of the primary and secondary leaf springs 70*a*, 70*b*, respectively. The secondary and tertiary leaf springs 70*b*, 70*c* provide additional rigidity to the structure of the shock absorber 70.

The illustrated leaf springs 70*a-c* are bow-shaped and are configured to elastically resist bending such that some of the energy from an impact on the bumper assembly 50 can be absorbed by the leaf springs 70*a-c* instead of damaging the merchandiser 10. The leaf springs 70*a-c* are made of, for example, a resilient material such as metal, plastic, or a combination of materials that elastically resist bending. For purposes of the description and the claims, the term "absorb" or other similar alternative are meant to include the conversion of kinetic energy into potential energy of spring-like elements and the dissipation of kinetic energy as the result of elements with damper-like characteristics to help protect the merchandiser 10 from damage due to an impact on the bumper assembly 50.

As illustrated in FIG. 5, each shock absorber 70 defines an attachment feature or pin connector 95 at each of the first end 75 and the second end 80 for removably attaching the shock absorber 70 to the support brackets 65 using a pin 100. Each pin 100 is inserted through slots 101 defined in the support brackets 65 and through the pin connector 95. Bushings or bearings 102 can be disposed in the pin connector 95 to tightly couple the leaf springs 70*a-c* to the brackets 65 while movement of the shock absorber 70 (e.g., along the slots 101, or pivotal or rotational movement if the connection point is rigidly secured to the brackets 65 (i.e. when no lateral movement of the pin connection relative to the bracket 65 is permitted) in response to a force acting on the shock absorber 70. The pin connector 95, the pins 100, the slots 101, and the bushings 102 cooperatively provide a quick release mechanism by which the shock absorbers 70 can be quickly attached and detached from the exterior surface 60 without the use of tools. For example, a user may remove the pins 100 from the pin connectors 95 and then freely detach the shock absorbers 70 with little effort. Cotter pins (not shown) can be used to inhibit dislodging of the pins 100 from the pin connector.

With reference to FIGS. 3 and 4, the bumper assembly 50 includes a rail attachment member 105, a bumper rail 110, and a bumper sleeve or cover 115 that is secured onto the bumper rail 110. The rail attachment member 105 attaches the bumper rail 110 to the shock absorbers 70 on the central portion 85. As illustrated, the rail attachment member 105 is coupled to each shock absorber 70 by a pair of holding pins 120 inserted through holes in the rail attachment member 105. The rail attachment member 105 and the holding pins 120 cooperatively sandwich the leaf springs 70*a-c* to attach the member 105 to the shock absorber 70. The rail attachment member 105 also includes a positioning pin 130 that is inserted into a hole 135 of the shock absorber 70 to maintain the position of the rail attachment member 105 relative to the central portion 85 (e.g., so that the rail attachment member 105 does not slide along the shock absorber 70).

The bumper rail 110 has a rigid structure that is coupled to the shock absorbers 70 by a plate 140, as shown in FIG. 3. The illustrated bumper rail 110 has a length that is approximately the same length as the base 15, although the bumper rail 110 could be longer or shorter than the base 15. The illustrated bumper rail 110 has an outwardly-convex curvature, and the bumper cover 115 slides over the bumper rail 110 and has a matching curved profile that can provide a desired aesthetic look to the bumper assembly 50 and a layer of cushion or protection over the bumper rail 110. In addition, the ends of the bumper rail 110 and the cover 115 can be covered or enclosed by an end cap (not shown). The bumper rail 110 can be formed of any material (e.g., metal (e.g., aluminum), metal alloy, plastic, composite, etc.) that is adequately rigid to transfer impact forces to the shock absorbers 70. The bumper cover 115 can be formed of any material that is suitable to prevent scratching, indentations, and to convey the desired aesthetic look (e.g., vinyl, foam, plastic, composite, metal, metal alloy, etc.).

In operation, the bumper assembly 50 protects the merchandiser 10 from damage that may otherwise be caused by an object impacting the bumper assembly 50. Absent an impact force, the shock absorbers 70 are in a first or unbiased state. As an object comes into contact with the bumper assembly 50, the force from the impact is transferred through the bumper cover 115 and dissipates laterally along the bumper rail 110. The bumper cover 115 can compress slightly during impact to absorb at least a portion of the impact energy. The impact force then acts on the rail attachment members 105, which transfers the force to one or more of the shock absorbers 70. The force causes the shock absorbers 70 to flex inward toward the base 15 of the merchandiser 10 (i.e. a second or biased state), thereby absorbing most of the impact energy. After the force has been dissipated, in large part by the shock absorbers 70, the shock absorbers 70 return to the first state. The bumper assembly 50 expands the impact area to a relatively large area to inhibit acute damage to the merchandiser 10.

Figure 7:
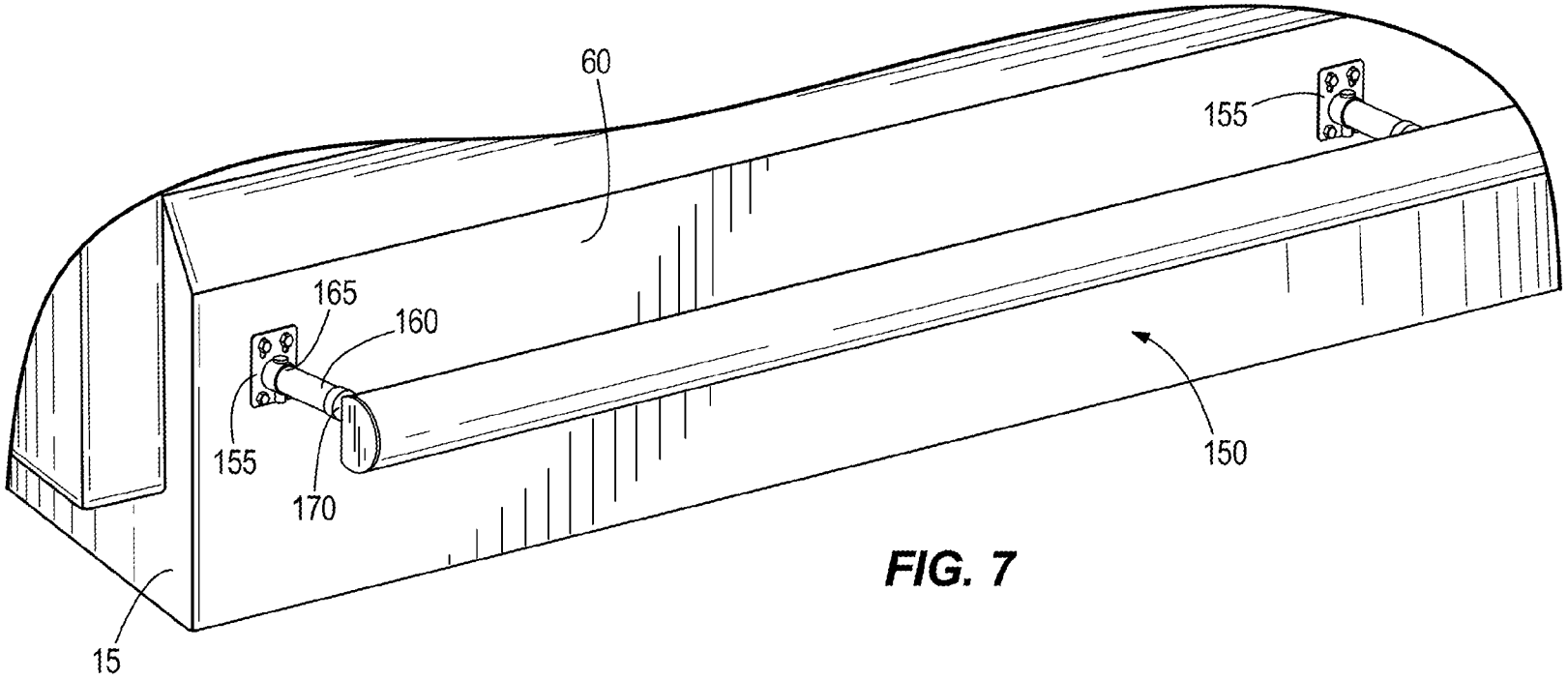
FIG. 7 is an enlarged perspective view of a portion of the bumper assembly.
Figure 8:
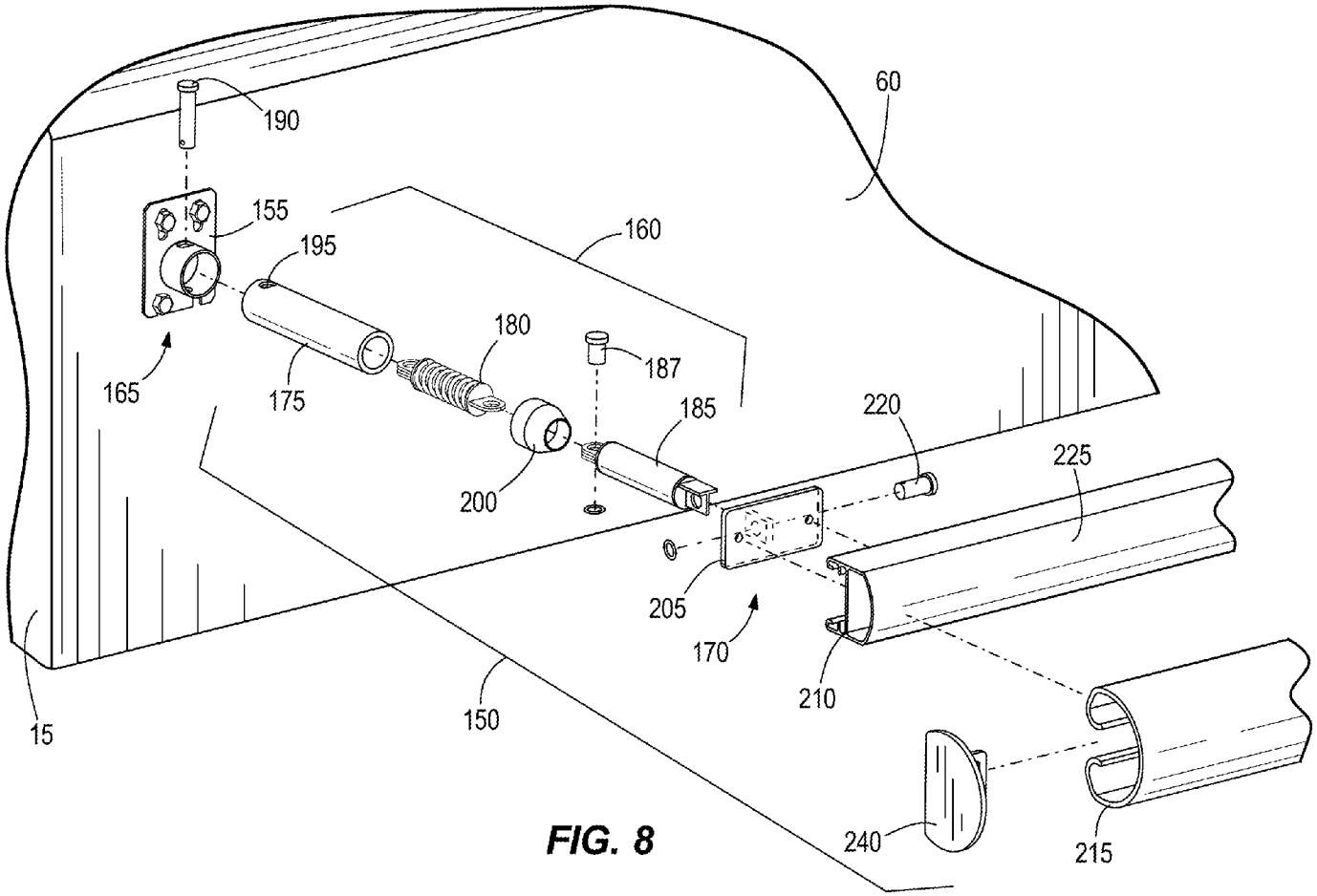
FIG. 8 is an exploded view of the bumper assembly of FIGS. 6 and 7.

FIGS. 6-8 illustrate the merchandiser 10 including another exemplary bumper assembly 150 that is removably attached to the base 15 by a plurality of brackets 155. The support brackets 155 are attached (e.g., bolted) to and horizontally-spaced along the exterior surface 60 of the merchandiser base 15. The brackets 155 can be part of the bumper assembly 150 or provided separate from the bumper assembly 150.

With reference to FIGS. 7 and 8, the bumper assembly 150 includes a plurality of horizontally-spaced shock absorbers 160 (referred to as "shock absorbers" for purposes of description only) that extend outward from the brackets 155 to resiliently attach the bumper assembly 150 to the base 15. Each shock absorber 160 has a first end 165 that is coupled one bracket 155, and a second or distal end 170 that attaches the remaining portions of the bumper assembly 150 to the base 15.

Referring to FIG. 8, each shock absorber 160 includes a housing 175, a bias member (e.g., a spring) 180 that is disposed in the housing 175, and a piston arm 185 that is engaged with and coupled to the bias member 180 (e.g., via a pin connector 187). The bias member 180 is coupled to the bracket 155 and to the first end 165 of the shock absorber 160 by a pin 190 that is inserted through a hole 195 in the housing 175. The bias member 180 and the piston arm 185 are positioned in the housing 175, and a cap 200 that seals the end of the housing 175 to inhibit infiltration of dirt and other debris. The pin 190 is inserted through the bracket 155, the housing 175, and the inner end of the bias member 180 to removably attach the assembly 150 to the base 15, and to provide a quick release mechanism to allow attachment and detachment of the bumper assembly 150 from the exterior surface 60 without the use of tools. For example, a user may remove the pins 190 from the brackets 155 and then freely detach the shock absorbers 160 with little effort. Cotter pins (not shown) can be used to inhibit dislodging the pins 100 from the pin connector.

With continued reference to FIG. 8, the bumper assembly 150 also includes a rail attachment member 205, a bumper rail 210, and a bumper sleeve or cover 215 that is secured onto the bumper rail 210. Each rail attachment member 205 is coupled to a corresponding shock absorber 160 by a fastener (e.g., a holding pin) 220 that is inserted through a hole in the piston arm 185 and a hole in the rail attachment member 205. Set screws or other fasteners are used to attach the bumper rail 210 to the rail attachment members 205.

As shown, the bumper rail 210 has a length that is approximately the same length as the base 15, although the bumper rail 210 could be longer or shorter than the base 15. The illustrated bumper rail 210 has an outwardly-convex curvature, and the bumper cover 215 slides over the bumper rail 210 and has a matching curved profile that can provide a desired aesthetic look to the bumper assembly 150 and a layer of cushion or protection over the bumper rail 210. In addition, the ends of the bumper rail 210 and cover 215 can be covered or enclosed by an end cap 240. The bumper rail 110 can be formed of any material (e.g., metal (e.g., aluminum), metal alloy, plastic, composite, etc.) that is adequately rigid to transfer impact forces to the shock absorbers 70. The bumper cover 115 can be formed of any material that is suitable to prevent scratching, indentations, and to convey the desired aesthetic look (e.g., vinyl, foam, plastic, composite, metal, metal alloy, etc.).

Referring to FIG. 8, the shock absorber 160 is assembled by inserting the bias member 180 into the housing 175 and then attaching the inner end of the bias member 180 to the bracket 155 via the pin 190. One end of the piston arm 185 is attached to the outer end of the bias member 180 via the fastener 187. The other end of the piston arm 185 is attached to the rail attachment member 205 by the fastener 220 after the cap is positioned over (e.g., slid onto) the piston arm 185. The cap is then coupled to the outer end of the housing.

In operation, the bumper assembly 150 protects the merchandiser 10 from damage that may otherwise be caused by an object impacting the bumper assembly 150. Absent an impact force, the shock absorbers 160 are in a first or unbiased state. In this first state, the piston arm 185 is biased away from the base 15 by the bias member 180. As an object comes into contact with the bumper assembly 150, the force from the impact is transferred through the bumper cover 215 and dissipates laterally along the bumper rail 210. The bumper cover 215 can compress slightly during impact to absorb at least a portion of the impact energy. The impact force then acts on the rail attachment members 205, which transfers the force to one or more of the shock absorbers 160. The force causes the shock absorbers 160 to move inward toward the base 15 against the bias of the bias member 180 to a second or biased state, thereby absorbing most of the impact energy. After the force has been dissipated, in large part by the shock absorbers 160, the shock absorbers 160 return to the first state. The bumper assembly 150 expands the impact area to a relatively large area to inhibit acute damage to the merchandiser 10.

Various features of the invention are set forth in the following claims.

The invention claimed is:

1. A merchandiser comprising:

a case including a base and side walls extending upward from the base to at least partially define a product display area;

a bracket coupled to the base; and a bumper assembly coupled to an exterior surface of the base, the bumper assembly including a shock absorber having at least one end removably coupled to the base by a quick release mechanism including a pin extending through and engaged with the bracket and the shock absorber, and a bumper coupled only to an outermost portion of the shock absorber.

2. The merchandiser of claim 1, wherein the shock absorber includes a first end attached to the bracket and the shock absorber extends outward from the base and has a second, distal end to which the bumper is attached.

3. The merchandiser of claim 2, wherein the shock absorber includes a first shock absorber and the bumper assembly further includes a second shock absorber horizontally spaced from the first shock absorber, and wherein the bumper extends between the first and second shock absorbers.

4. The merchandiser of claim 3, wherein the bumper is biased outward from the base by the first and second shock absorbers.

5. The merchandiser of claim 1, wherein the bracket includes a first bracket coupled to the base and the merchandiser includes a second bracket spaced from the first bracket, and wherein the shock absorber extends horizontally along the base between the first bracket and the second bracket and a central portion of the shock absorber defines the outermost portion.

6. The merchandiser of claim 5, wherein the shock absorber includes a first shock absorber and the bumper assembly further includes a second shock absorber coupled to the base such that the second shock absorber extends horizontally across the base laterally adjacent the first shock absorber, and wherein the bumper continuously extends from a first end of the first shock absorber to a second end of the second shock absorber.

7. A merchandiser comprising:

a case including a base and side walls extending upward from the base to at least partially define a product display area; and a bumper assembly coupled to an exterior surface of the base, the bumper assembly including a shock absorber including a leaf spring and having a first attachment at a first end removably coupled to the base by a fastener and a second attachment at a second end removably coupled to the base by another fastener such that the shock absorber extends horizontally along the base, the shock absorber further including a central portion disposed between the first end and the second end and spaced from the exterior surface such that only the first end and the second end are attached to the base, and an elongate bumper coupled to the shock absorber.

8. The merchandiser of claim 7, wherein the shock absorber includes a first shock absorber, the bumper assembly further including a second shock absorber having a first end coupled to the base and a second end coupled to the base such that the second shock absorber extends horizontally across the base, and wherein the bumper continuously extends from the first end of the first shock absorber to the second end of the second shock absorber.

9. The merchandiser of claim 8, wherein the first end of the second shock absorber is coupled to the base laterally adjacent the second end of the first shock absorber.

10. The merchandiser of claim 7, further comprising brackets attached to the base adjacent the first and second ends and engaged by the respective fasteners.

11. The merchandiser of claim 7, wherein the bumper is coupled to the shock absorber only at the central portion.

12. The merchandiser of claim 7, wherein the bumper is removably coupled to the central portion by a pinned connection.

13. A merchandiser comprising:

a case including a base and side walls extending upward from the base to at least partially define a product display area;

a bracket coupled to the base; and a bumper assembly coupled to an exterior surface of the base, the bumper assembly including a shock absorber elongated in a longitudinal direction and having at least one end removably coupled to the base by a quick release mechanism engaged with the bracket and the shock absorber; and a bumper coupled only to an outermost portion of the shock absorber, wherein the quick release mechanism extends through the shock absorber across a longitudinal axis of the shock absorber.

14. The merchandiser of claim 13, wherein the shock absorber includes a first end attached to the bracket and the shock absorber extends outward from the base and has a second, distal end to which the bumper is attached.

15. The merchandiser of claim 14, wherein the shock absorber includes a first shock absorber and the bumper assembly further includes a second shock absorber horizontally spaced from the first shock absorber, and wherein the bumper extends between the first and second shock absorbers.

16. The merchandiser of claim 15, wherein the bumper is biased outward from the base by the first and second shock absorbers.

17. The merchandiser of claim 13, wherein the bracket includes a first bracket coupled to the base and the merchandiser includes a second bracket spaced from the first bracket, and wherein the shock absorber extends horizontally along the base between the first bracket and the second bracket and a central portion of the shock absorber defines the outermost portion.

18. The merchandiser of claim 17, wherein the shock absorber includes a first shock absorber and the bumper assembly further includes a second shock absorber coupled to the base such that the second shock absorber extends horizontally across the base laterally adjacent the first shock absorber, and wherein the bumper continuously extends from a first end of the first shock absorber to a second end of the second shock absorber.

19. The merchandiser of claim 18, wherein the first end of the second shock absorber is coupled to the base laterally adjacent the second end of the first shock absorber.

20. The merchandiser of claim 13, wherein the shock absorber has a first attachment at a first end removably coupled to the base by a fastener and a second attachment at a second end removably coupled to the base by another fastener such that the shock absorber extends horizontally along the base, the shock absorber further including a central portion disposed between the first end and the second end and spaced from the exterior surface such that only the first end and the second end are attached to the base.

* * * * *